US009085160B2

(12) United States Patent
Hanaoka et al.

(10) Patent No.: US 9,085,160 B2
(45) Date of Patent: Jul. 21, 2015

(54) RECORDING APPARATUS

(71) Applicant: SEIKO EPSON CORPORATION, Tokyo (JP)

(72) Inventors: Yukihiro Hanaoka, Shiojiri (JP); Tatsuya Seshimo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/210,942

(22) Filed: Mar. 14, 2014

(65) Prior Publication Data

US 2014/0285571 A1 Sep. 25, 2014

(30) Foreign Application Priority Data

Mar. 25, 2013 (JP) ..... 2013-062841

(51) Int. Cl.
*B41J 2/165* (2006.01)
*B41J 25/308* (2006.01)

(52) U.S. Cl.
CPC ..... *B41J 2/16585* (2013.01); *B41J 2/16532* (2013.01); *B41J 2/16538* (2013.01); *B41J 25/3088* (2013.01)

(58) Field of Classification Search
CPC .. B41J 2/1652; B41J 2/16585; B41J 2/16532; B41J 2/16538; B41J 25/3088
USPC ..... 347/30–33
See application file for complete search history.

(56) References Cited

U.S. PATENT DOCUMENTS

| | | | | |
|---|---|---|---|---|
| 2008/0316253 | A1* | 12/2008 | Inuoe | 347/33 |
| 2009/0096830 | A1* | 4/2009 | Shimazaki | 347/30 |
| 2011/0273515 | A1* | 11/2011 | Hara et al. | 347/68 |
| 2011/0279525 | A1* | 11/2011 | Suzuki et al. | 347/30 |
| 2012/0156449 | A1 | 6/2012 | Tateishi et al. | |
| 2012/0218346 | A1* | 8/2012 | Inoue | 347/33 |
| 2012/0224001 | A1* | 9/2012 | Park | 347/30 |

FOREIGN PATENT DOCUMENTS

| | | |
|---|---|---|
| JP | 2007-190766 | 8/2007 |
| JP | 2008-049661 | 3/2008 |
| WO | 2011-027842 | 3/2011 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording apparatus includes a transportation mechanism that supports and transports a recording medium by a support surface; a recording head that is disposed in a region facing the support surface and is capable of ejecting an ink from a nozzle provided on an ink ejection surface to the recording medium; a suction unit that is capable of sucking the ink inside the nozzle; and a wiping unit that is provided as a separate body from the suction unit and is capable of wiping the ink ejection surface. At least one of the suction unit and the wiping unit is provided on a farther downstream side of the recording medium in a transportation direction than the recording head and a gap between the one and the support surface is wider than a gap between the ink ejection surface and the support surface.

8 Claims, 4 Drawing Sheets

RECORDING APPARATUS

BACKGROUND

1. Technical Field

The present invention relates to a recording apparatus that ejects an ink from a nozzle provided on an ink ejection surface of a recording head and records on a recording medium.

2. Related Art

Hitherto, recording apparatuses which eject an ink from a nozzle provided on an ink ejection surface of a recording head and record on a recording medium have been used. In such recording apparatuses, a recording apparatus including a suction unit that is capable of sucking the ink inside the nozzle and a wiping unit that is capable of wiping the ink ejection surface have been commonly used. For example, in JP-A-2007-190766, there is disclosed a liquid ejection apparatus including a maintenance unit in which the suction unit and the wiping unit are integrated.

Meanwhile, there is a demand for miniaturization of the recording apparatus to widen a selection range of installation locations of the recording apparatus.

An integrated unit of a suction unit and a wiping unit is increased in volume.

However, in a recording apparatus including a discharge mechanism that inverts and discharges a recorded recording medium, particularly, in a liquid droplet ejecting apparatus disclosed in JP-A-2007-190766, there is a limit in a space for accommodating the suction unit and the wiping unit. Therefore, the apparatus needs to be increased in size to accommodate a unit having a large volume.

In addition, particularly, recording apparatuses including a line head have a fast recording speed and it is easy for a recording medium to be curled immediately after recording. Therefore, there is a possibility that the recording medium curled immediately after the recording may interfere with a portion of configuration members of the recording apparatus. If the recording medium interferes with the portion of the configuration members of the recording apparatus, there is a possibility of damaging the recording medium and the configuration members of the recording apparatus, in addition to a possibility of damaging a recording image that is recorded on the recording medium.

SUMMARY

An advantage of an aspect of the present invention is to provide a recording apparatus that suppresses a recording medium curled immediately after recording from interfering with a portion of configuration members of the recording apparatus and is capable of accommodating a suction unit and a wiping unit without increasing the apparatus in size.

According to an aspect of the invention, there is provided a recording apparatus including a transportation mechanism that supports and transports the recording medium by a support surface; a recording head that is disposed in a region facing the support surface and is capable of ejecting an ink from a nozzle provided on an ink ejection surface to the recording medium; a suction unit that is capable of sucking the ink inside the nozzle; and a wiping unit that is provided as a separate body from the suction unit and is capable of wiping the ink ejection surface. At least one of the suction unit and the wiping unit is provided on a farther downstream side of the recording medium in a transportation direction than the recording head and a gap between the one and the support surface is wider than a gap between the ink ejection surface and the support surface.

In this case, at least one of the suction unit and the wiping unit may be provided on the farther downstream side of the recording medium in the transportation direction than the recording head and the gap between the one and the support surface may be wide. Therefore, it is possible to suppress the recording medium curled immediately after recording from interfering with a portion of configuration members of the recording apparatus.

In addition, in this case, the suction unit and the wiping unit may be provided as separate bodies from each other. Therefore, it is possible to configure the suction unit to be thinner than an integrated unit of the suction unit and the wiping unit and, for example, to shorten a clearance distance of the recording head from the support surface when moving the suction unit to a space between the recording head and the support surface. That is, it is possible to suppress the apparatus from increasing in size. Generally, a timing of sucking the ink inside the nozzle and a timing of wiping the ink ejection surface are different from each other. However, in this case, the suction unit and the wiping unit may be driven independently, and thus, a load of driving can be suppressed at the time of each operation.

The term "farther downstream side of the recording medium in the transportation direction than the recording head" denotes a downstream side of the recording medium in the transportation direction on the basis of the ink ejection surface.

In addition, the suction unit is used to mean that when there are a plurality of recording heads, the suction unit may be configured either in an assembly body configuration with a plurality of suction caps provided to correspond to each of the recording heads or in a single body configuration with a single suction cap that collectively performs sucking with respect to the plurality of recording heads. Furthermore, the term is used, in a case of the assembly body configuration of the suction caps, to mean that either a configuration in which drive sources individually drive sucking for each suction cap or a configuration in which a single drive source collectively drives sucking for each suction cap is included.

In the recording apparatus, it is preferable that one of the suction unit and the wiping unit is provided on a farther upstream side in the transportation direction than the recording head, and the other one is provided on the farther downstream side in the transportation direction than the recording head.

In this case, one of the suction unit and the wiping unit may be disposed on the upstream side in the transportation direction, and the other one may be disposed on the downstream side in the transportation direction. Therefore, it is possible to efficiently utilize a space within the apparatus and to suppress the apparatus from increasing in size.

The term "farther upstream side in the transportation direction than the recording head" denotes an upstream side in the transportation direction on the basis of the ink ejection surface. In addition, the term "farther downstream side in the transportation direction than the recording head" denotes a downstream side in the transportation direction on the basis of the ink ejection surface.

In the recording apparatus, it is preferable that the transportation mechanism have an endless belt that is capable of supporting the recording medium.

Here, as a specific example of the "endless belt", a belt can be exemplified which supports the recording medium by causing the recording medium to adhere to the belt such as an adhesive belt and an electrostatic attraction-type belt having an adhesive agent on the support surface so that the recording medium adheres thereto in a strippable manner. However, the belt is not limited thereto.

In this case, the endless belt may support the recording medium and transport the recording medium. Particularly, if a belt causing the recording medium to adhere thereto and supporting the recording medium is employed, it is possible to suppress the recording medium from being curled while the recording medium adheres to the belt, and thus, it is possible to suppress the recording medium from interfering with configuration members of the recording apparatus.

In the recording apparatus, it is preferable that the recording head be disposed on the upstream side of the recording medium in the transportation direction within a region facing a region where the endless belt transports the recording medium.

In general recording apparatuses, in a state where the recording medium is at a position facing the recording head, a gap between the recording medium and the recording head is regularly maintained. When recording on the recording medium, in order to regularly maintain the gap between the recording medium and the recording head from a beginning of recording until an end of the recording, in many cases of the recording apparatus, the support surface of the recording medium is lengthily provided on a downstream side of the recording medium in the transportation direction with respect to the recording head. In this case, particularly in such a recording apparatus, at least one of the suction unit and the wiping unit may be disposed in a space facing the support surface on the downstream side of the recording medium in the transportation direction with respect to the recording head. That is, a space inside the apparatus can be efficiently utilized, and thus, the apparatus can be suppressed from increasing in size.

In the recording apparatus, it is preferable to include a first movement mechanism that is capable of moving in a direction in which the recording head approaches and is separated away from the support surface; a second movement mechanism that is capable of moving the suction unit; a third movement mechanism that is capable of moving the wiping unit; and a control unit that controls the first movement mechanism so as to move the recording head in the direction to be separated away from the support surface and controls the second movement mechanism so as to move the suction unit to a suction position facing the ink ejection surface when sucking the ink inside the nozzle, and controls the second movement mechanism so as to cause the suction unit to be positioned below the recording head and controls the third movement mechanism so as to move the wiping unit to the position facing the ink ejection surface when wiping the ink ejection surface.

Here, the term "moving" in "capable of moving in a direction in which the recording head approaches and is separated from the support surface" is also used, in the present specification, without being limited to a configuration in which the recording head moves with respect to the support surface, to mean that a configuration in which the support surface moves with respect to the recording head is included and a configuration in which either the recording head or the support surface moves with respect to the other is further included. That is, the term is used to mean that the recording head and the support surface are relatively capable of moving in a direction to approach and be separated from each other.

In addition, the term "direction" in "moving in a direction to approach and be separated from the support surface" is also used, without being limited to a direction orthogonal to the support surface, to mean that a movement in an oblique direction is included. In a case of the oblique direction, it is preferable to be within 45 degrees based on the orthogonal direction.

In addition, the term "suction position" denotes a position where the suction unit is operated to suck the ink inside the nozzle with respect to the recording head.

In addition, the term "below the recording head" is used to mean that not only a lower side of the recording head in a vertical direction but also a peripheral position thereof are included, and that is a position capable of receiving at least a portion of the ink dripped from the recording head. The ink dripped from the recording head includes, for example, an ink dripped from the recording head via other members such as the wiping unit in addition to the ink dripped directly from the recording head.

In addition, the term "move the wiping unit to the position facing the ink ejection surface" is used to mean that a movement of a portion of the wiping unit to the position facing the ink ejection surface in addition to a movement of the wiping unit in its entirety to the position facing the ink ejection surface is included.

In this case, when wiping the ink ejection surface, the suction unit may move to the position where the ink dripped from the recording head can be received. Therefore, it is possible to suppress the ink from dripping onto the support surface of the recording medium.

In the recording apparatus, it is preferable that the wiping unit have a wiping member, and the wiping member be replaceable.

Here, the term "wiping member" denotes a member that comes into contact with the ink ejection surface among members configuring the wiping unit.

In this case, only the wiping member may be replaced among the members configuring the wiping unit, and thus, it is possible to suppress a running cost. Here, it is preferable that the wiping member be a suction member in that the ink can be suppressed from dripping from the recording head during the wiping.

In the recording apparatus, it is preferable to include a discharge mechanism that inverts and discharges the recording medium recorded by ejection of the ink from the nozzle.

In the recording apparatus including the discharge mechanism that inverts and discharges the recorded recording medium, in order to secure a movement route of the recording medium to invert the recording medium, in many cases, the discharge mechanism is provided in an upper portion of the recording apparatus. In many cases, such a recording apparatus has a space in at least one of an upstream side and a downstream side of the recording medium in the transportation direction with respect to the recording head. In this case, particularly in such a recording apparatus, at least one of the suction unit and the wiping unit may be disposed in a space facing the support surface on the downstream side of the recording medium in the transportation direction with respect to the recording head. That is, a space inside the apparatus can be efficiently utilized, and thus, the apparatus can be suppressed from increasing in size.

In the recording apparatus, it is preferable that the recording head be a line head.

Since a recording speed of the recording apparatus including the line head as the recording head is fast generally, it is easy to occur the curling on the recording medium and the recording medium is easily interfered with the configuration members of the recording apparatus. In this case, since a gap between a unit that is provided on the farther downstream side in the transportation direction than the recording head and the support surface may be configured to be wide, even though the line head is provided as the recording head, it is possible to suppress the recording medium from interfering with the configuration members of the recording apparatus.

Here, the "line head" is a recording head that is employed in a recording apparatus in which a region of the nozzle that is formed in the intersection direction intersecting the transportation direction of the recording medium is provided to be able to cover the recording medium in the intersection direction entirely and in which one of the recording head or the recording medium is fixed and the other thereof moves to form an image. The region of the nozzle of the line head in the intersection direction does not need to be able to cover all the recording mediums in the whole intersection direction which are handled by the recording apparatus.

In the recording apparatus, it is preferable that the ink contain water within a range of 20 mass % to 70 mass %.

The recording medium is greatly influenced by an amount of the water within the ink in forming a curl thereon. In addition, in consideration of environmental characteristics, it is preferable that the amount of the water be within a range of 20 mass % to 70 mass %. In this case, the amount of the water within the ink may be included in this preferable range.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

FIGS. 1 to 4

Hereinafter, a recording apparatus according to an embodiment of the present invention will be described in detail with reference to the drawings.

First, an overview of the recording apparatus according to the embodiment of the invention will be described. The recording apparatus according to the embodiment is a recording apparatus having an electrostatic attraction-type endless belt as a transportation mechanism that supports a recording medium by a support surface. However the apparatus is not limited to such a configuration.

Figure 1:
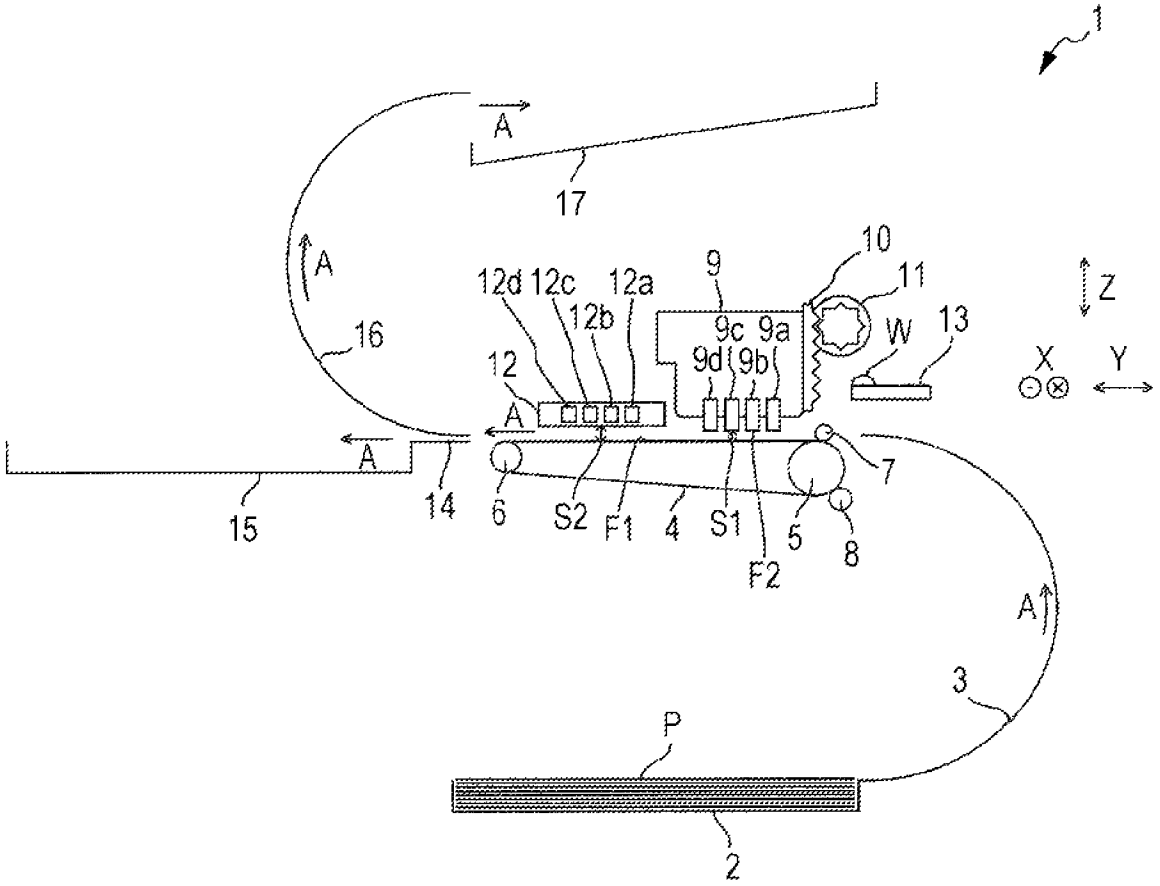
FIG. 1 is a schematic side view showing a state where a recording head, a suction unit and a wiping unit are respectively at home positions in a recording apparatus according to an embodiment of the present invention.

FIG. 1 is a schematic side view showing a state where a recording head 9, a suction unit 12 and a wiping unit 13 are respectively at home positions in a recording apparatus 1 according to the embodiment of the invention.

The recording apparatus 1 according to the embodiment includes a tray 2 that holds a recording medium P on which recording is performed. The recording medium P is transported from the tray 2 to an endless belt 4 through a transportation route 3 in a transportation direction A by a transportation roller (not illustrated) and the like. The recording medium P transported through the transportation route 3 is pressed by a pressure roller 7 and adheres to the endless belt 4.

The recording medium P that adheres to and is supported by a support surface F1 of the endless belt 4 is disposed in a region facing the support surface F1 while being transported in the transportation direction A. The recording medium P is recorded by a recording head 9 that is a line head capable of ejecting an ink onto the recording medium P from a nozzle provided on an ink ejection surface F2. Then, the recording medium P is stacked in a tray 15 via a transportation route 14 or stacked in a tray 17 via a transportation route 16. Here, the transportation route 16 serves as a discharge mechanism that inverts and discharges the recording medium P recorded by the recording head 9.

In the recording apparatus including the discharge mechanism that inverts and discharges the recorded recording medium P, in order to secure a movement route of the recording medium P to invert the recording medium P, in many cases, the discharge mechanism is provided in an upper portion of the recording apparatus. In many cases, such a recording apparatus has a space in at least one of an upstream side and a downstream side of the recording medium P in the transportation direction A with respect to the recording head 9 because, in many cases, a tray or the like that stacks the recording medium P over a predetermined range in an upper portion of the recording head 9 is provided, and in many cases, a space is formed in a lower portion of the tray or the like. Therefore, at least one of the suction unit 12 and the wiping unit 13 is disposed in the space to efficiently utilize the space, and thus, it is possible to suppress the apparatus from increasing in size. In the recording apparatus 1 according to the embodiment, the suction unit 12 and the wiping unit 13 are disposed in the space.

Here, the "line head" is a recording head that is employed in a recording apparatus in which a region of the nozzle that is formed in the intersection direction intersecting the transportation direction A of the recording medium P is provided to be able to cover the recording medium P in the intersection direction entirely and in which one of the recording head or the recording medium P is fixed and the other thereof moves to form an image. The region of the nozzle of the line head in the intersection direction does not need to be able to cover all the recording mediums in the intersection direction entirely which are handled by apparatus.

If the endless belt 4 causing the recording medium P to adhere to the one and supporting the recording medium P is employed, it is possible to suppress the recording medium P from being curled while the recording medium P adheres to the endless belt 4, and thus, it is possible to suppress the recording medium P from interfering with configuration members of the recording apparatus 1. In addition, as another example of the endless belt 4, there are an adhesive belt and the like having an adhesive agent on the support surface F1 so that the recording medium adheres thereto in a strippable manner so as to be preferably used.

The recording apparatus 1 according to the embodiment is configured to be able to record with a black ink, a cyan ink, a magenta ink and a yellow ink. In the recording head 9, there are provided a recording head 9*a* corresponding to the black ink, a recording head 9*b* corresponding to the cyan ink, a recording head 9*c* corresponding to the magenta ink and a recording head 9*d* corresponding to the yellow ink. In each of the recording heads 9*a* to 9*d*, a surface that faces the endless belt 4 is an ink ejection surface F2 where the nozzle ejecting the ink is provided. That is, in the recording apparatus 1 according to the embodiment, the ink is configured of inks in plural colors, and the recording head 9 is provided in plural numbers for each color.

Color Material

A color material is included in an ink composition according to the embodiment. The color material may be any one of a dye and a pigment.

As the dye, various types of dye usable for ink jet recording can be exemplified such as a direct dye, an acid dye, an edible dye, a basic dye, a reactive dye, a disperse dye, a vat dye, a soluble vat dye and a reactive disperse dye.

As the pigment, without being particularly limited, an inorganic pigment or an organic pigment can be used. As the inorganic pigment for the black ink, pigments of a carbon black (C.I. pigment black 7) type can be exemplified such as, in addition to titanium oxide and iron oxide, furnace black, lamb black, acetylene black and channel black. As the organic pigment for the black ink, black organic pigments can be exemplified such as aniline black (C.I. pigment black 1).

As the pigment for the yellow ink, pigments can be exemplified such as C.I. pigment yellow 1 (hansa yellow), 3 (hansa yellow 10G), 12, 13, 14, 17, 24 (flavanthrone yellow), 34, 35, 37, 53, 55, 65, 73, 74, 81, 83, 93, 94, 95, 97, 98, 99, 108 (anthrapyrimidine yellow), 109, 110, 113, 117 (copper complex pigment), 120, 128, 133 (quinophthalones), 138, 139 (isoindolinone), 147, 151, 153 (nickel complex pigment), 154, 155, 167, 172, 180, 185 and 213; and the pigment referenced in Formula 1 of WO 2011/027842.

As the pigment for the magenta ink, pigments can be exemplified such as C.I. pigment red 1 (paranitraniline red), 2, 3 (toluidine red), 5 (ITR red), 7, 9, 10, 11, 12, 17, 30, 31, 38 (pyrazolone red), 42, 88 (thioindigo), 112 (naphthol AS series), 114 (naphthol AS series), 122 (dimethylquinacridone), 123, 144, 149, 150, 166, 168 (anthanthrone orange), 170 (naphthol AS series), 171, 175, 176, 177 178, 179 (perylene maroon), 185, 187, 209 (dichloro-quinacridone), 219, 224 (perylene-based) and 245 (naphthol AS series); and C.I. pigment violet 19 (quinacridone), 23 (dioxazine violet), 32, 33, 36, 38, 43 and 50.

Resin

A resin particle may be included in the ink composition according to the embodiment. The resin particle is included in the ink composition, and thus, it is possible to form an image excellent in scratch resistance on the recording medium. Particularly, in the ink composition according to the embodiment, it is preferable that the resin particle be included in a state of minute particle (that is, emulsion state or suspension state). The resin particle is included in the state of minute particle, and thus, it is easy to adjust viscosity of the ink composition within an appropriate range for an ink jet recording method and easy to secure preservation stability and ejection stability.

As the resin particle, for example, a polymer particle can be exemplified having an effect of forming a resin film to be fixed upon the recording medium. A composition ingredient of the polymer particle having such an effect can be exemplified such as polyacrylic acid ester and a copolymer thereof; polymethacrylic acid ester and a copolymer thereof; polyacrylonitrile and a copolymer thereof; polycyanoacrylates, polyacrylamide, polyacrylic acid, polymethacrylic acid, polyethylene, polypropylene, polybutene, polyisobutylene, polystyrene and copolymers thereamong; a petroleum resin; a chromanindene resin; a terpene resin; polyvinyl acetate and a copolymer thereof; polyvinyl alcohol; polyvinyl acetal; polyvinyl ether; polyvinyl chloride and a copolymer thereof; polyvinylidene chloride; fluorine resin; fluorine rubber; polyvinyl carbazole; polyvinyl pyridine; polyvinyl imidazole; polybutadiene and a copolymer and a copolymer thereof; Polychloroprene; polyisoprene; and a natural resin, for example. Among these, particularly, a resin particle having both a hydrophobic property and a hydrophilic property together in molecular structure is preferable.

If the resin particle is included, it is preferable that a content of the resin particle in the total mass of the ink composition be within a range of 0.5 mass % to 10 mass %. When the content of the resin particle is within the above-referenced range, solidification and fixation of the ink composition on the recording medium can be promoted.

Water

It is preferable that pure water or ultra-pure water such as ion exchange water, ultrafiltration water, reverse osmosis water, and distilled water be used for water. In consideration of a great influence on forming of curling and environmental characteristics, it is preferable that an amount of the water be within a range of 20 mass % to 70 mass %, and it is more preferable to be within a range of 30 mass % to 65 mass %.

Water Soluble Organic Solvent

As a water-soluble organic solvent, for example, polyhydric alcohols, a derivative of pyrrolidone, and glycol ether can be exemplified. The water-soluble organic solvent may be employed alone or employed in combination of two or more types.

As the polyhydric alcohols, ethylene glycol, diethylene glycol, triethylene glycol, polyethylene glycol, polypropylene glycol, dipropylene glycol, propylene glycol, butylene glycol, 1,2-butanediol, 1,2-pentanediol, 1,5-pentanediol, 1,2-hexanediol, 2-ethyl-1,3-hexanediol, 1,6-hexanediol, 1,2-heptanediol, 1,2-octanediol, 1,2,6-hexanetriol, thioglycol, hexylene glycol, glycerin, trimethylol ethane, trimethylolpropane and the like may be exemplified. These polyhydric alcohols exhibit an effect to reduce clogging of a nozzle hole when ejecting the ink composition from the nozzle hole of the ink jet recording apparatus.

As the derivative of pyrrolidone, for example, N-methyl-2-pyrrolidone, N-ethyl-2-pyrrolidone, N-vinyl-2-pyrrolidone, 2-pyrrolidone, 5-methyl-2-pyrrolidone can be exemplified.

As the glycol ethers, for example, triethylene glycol monobutyl ether, diethylene glycol monobutyl ether, dipropylene glycol propyl ether, diethylene glycol diethyl ether, penta-ethylene glycol monobutyl ether can be exemplified.

Surfactant

A surfactant can appropriately maintain surface tension of the resin ink composition and interfacial tension with respect to printer members such as the nozzle and the like which come into contact with the ink composition. Therefore, when the above-referenced surfactant is employed in the ink jet recording apparatus, it is possible to enhance the ejection stability. In addition, an effect of being uniformly wet over the recording medium is achieved.

As the surfactant having such an effect, it is preferable to employ a nonion-based surfactant. In the nonion-based surfactants, it is more preferable to employ at least one type chosen from among a fluorine-based surfactant, a silicone-based surfactant and an acetylene glycol-based surfactant. Furthermore, in addition to the above-referenced surfactants, an anionic surfactant, a nonionic surfactant, an amphoteric surfactant and the like may be added.

In addition, it is preferable that the ink composition according to the embodiment of the invention not substantially include 1,2-alkanediol having 5 or 6 carbon atoms. Such an organic solvent tends to scatter an ejected ink droplet and tends to generate more mist. Therefore, in order to reduce vapor as much as possible, it is preferable not to substantially include 1,2-alkanediol having 5 or 6 carbon atoms in the ink composition according to the embodiment of the invention.

According to the embodiment of the invention, a term "color material is not substantially included" includes a case where the color material is not intentionally added or is not allowed to be included more than an amount to be satisfactorily deemed that the color material is added. Accordingly, the ink composition may include a slight amount of the color material that unavoidably mixes or is generated therein during manufacturing or storing. As an example, as a specific example of "not being substantially included", supposedly, the ink composition does not include the color material of 1.0 mass % or more and it is preferable not to include 0.5 mass % or more, more preferable not to include 0.1 mass % or more, further preferable not to include 0.05 mass % or more, and still further preferable not to include 0.01 mass % or more.

The surface tension of the ink used in the recording apparatus 1 according to the embodiment, under an environment of 25° C., is within a range of 25 mN/m to 60 mN/m. It is more preferable to be within a range of 28 mN/m to 38 mN/m. In addition, the viscosity is within a range of 1.6 mPa·s to 20 mPa·s and is more preferable within a range of 1.8 mPa·s to 8 mPa·s.

In addition, a configuration material of the ink ejection surface F2 in the recording head 9 according to the embodiment is silicon. However, stainless steel, plastic and the like can be preferably used. A contact angle of each of the ink on the ink ejection surface F2 is equal to or larger than 50 degrees. In addition, it is preferable that an ink repellent film employing a fluorine-based material (for example, fluorinated alkylsilane) be formed on the configuration material of the ink ejection surface F2.

Even though the ink and the ink ejection surface F2 satisfying such conditions are employed to be able to stably eject the ink, there easily occurs the disadvantage in that the ink drips onto the support surface F1 of the recording medium P during the wiping. In this regard, in the recording apparatus according to the embodiment of the invention employing the ink and the ink ejection surface F2 satisfying such conditions, an effect of suppressing the ink from dripping onto the support surface F1 of the recording medium P may be particularly exhibited.

Even though the ink satisfying such conditions is employed to be able to stably eject the ink, there easily occurs the curling of the recording medium P immediately after the recording. In this regard, the recording apparatus according to the embodiment of the invention employing the ink that satisfies such conditions particularly exhibits an effect of suppressing the recording medium P curled immediately after the recording from interfering with a portion of the configuration members of the recording apparatus.

In order to more effectively suppress the interference caused by occurrence of the curling of the recording medium P immediately after the recording between the recording medium P and the suction unit 12 that is capable of sucking the ink inside the nozzle, the suction unit 12 may be configured to be capable of moving in a direction intersecting the support surface F1 of the recording medium P. Furthermore, the wiping unit 13 that is provided as a separate body from the suction unit 12 and is capable of wiping the ink ejection surface F2 may be configured to be capable of moving in the direction intersecting the support surface F1 of the recording medium P. As a representative example of the recording medium P, there is a recording medium employing a sheet of paper represented by plain paper and coated paper.

In addition, even though the recording apparatus 1 according to the embodiment is a recording apparatus including the line head that is capable of recording with the black ink, the cyan ink, the magenta ink and the yellow ink, the recording apparatus 1 is not limited to such a configuration. The recording apparatus may cause the recording head 9 to reciprocally scan. The recording apparatus may be capable of using inks in other colors.

Since a recording speed of the recording apparatus including the line head as the recording head 9 is fast generally, it is easy for the curling to occur on the recording medium P and the recording medium P easily interferes with the configuration members of the recording apparatus. As described below, the recording apparatus 1 according to the embodiment is configured to have a gap S2 between the suction unit 12 that is provided on the farther downstream side of the recording medium P in the transportation direction A than the recording head 9 and the support surface F1 to be wider than a gap S1 between the recording head 9 and the support surface F1. Accordingly, even though the curling occurs easily by having the line head as the recording head 9, it is configured to be possible to suppress the recording medium P from interfering with the configuration members of the recording apparatus 1.

In addition, in the recording apparatus having the line head as the recording head 9 since, it is difficult to move the recording head 9 from the position facing the support surface F1, there is a possibility that the ink may drip from the recording head 9 to the support surface F1. As described below, when wiping the ink ejection surface F2, the recording apparatus 1 according to the embodiment moves the suction unit 12 to a position where the ink dripped from the recording head 9 can be received. Therefore, even though the line head is provided as the recording head 9, it is configured to be possible to suppress the ink from dripping on the support surface F1.

The transportation mechanism in the recording apparatus 1 according to the embodiment is configured to charge the electrostatic attraction-type endless belt 4 by a charging roller 8 and rotate the endless belt 4 by rollers 5 and 6, thereby transporting the recording medium P. In the recording apparatus 1 according to the embodiment, the recording head 9 is disposed on the upstream side in the transportation direction A in the region facing the region to which the recording medium P on the endless belt 4 is transported.

In general recording apparatuses, in a state where the recording medium P is at a position facing the recording head 9, a gap between the recording medium P and the recording head 9 is regularly maintained. When recording on the recording medium P, in order to regularly maintain the gap between the recording medium P and the recording head 9 from a beginning of recording until an end of the recording, in many cases of the recording apparatus, the support surface F1 of the recording medium P is lengthily provided on the downstream side of the recording medium P in the transportation direction A with respect to the recording head 9. Therefore, at least one of the suction unit 12 and the wiping unit 13 is disposed in a space facing the support surface F1 on the downstream side of the recording medium P in the transportation direction A with respect to the recording head 9, and thus, a space inside the apparatus can be efficiently utilized, and the apparatus can be suppressed from increasing in size.

In the recording apparatus 1 according to the embodiment, the suction unit 12 is disposed in the space facing the support surface F1 on the downstream side of the recording medium P in the transportation direction A with respect to the recording head 9.

In addition, the recording apparatus 1 according to the embodiment includes the wiping unit 13 having a wiping member W on the upstream side of the recording head 9 in the transportation direction A and includes the suction unit 12 on the downstream side of the recording head 9 in the transportation direction A. According to such a configuration, the space within the recording apparatus 1 is efficiently utilized, thereby achieving miniaturization of the recording apparatus 1. In this manner, in order to efficiently utilize the space within the recording apparatus 1 and to miniaturize the recording apparatus 1, it is preferable that at least one of the suction unit 12 and the wiping unit 13 be disposed on the farther downstream side in the transportation direction than the recording head 9 in the region facing the region to which the endless belt 4 transports the recording medium P. Furthermore, it is more preferable that one of the suction unit 12 and the wiping unit 13 be disposed on the upstream side and the other one be disposed on the downstream side.

Here, the term "wiping member" denotes a member that comes into contact with the ink ejection surface F2 among the members configuring the wiping unit 13.

However, it is not particularly limited thereto, if the suction unit 12 and the wiping unit 13 are configured in separate bodies. Because if the suction unit 12 and the wiping unit 13 are configured in separate bodies, it is possible to configure the suction unit 12 and the wiping unit 13 in a thin shape, and thus, it is possible to make the recording apparatus 1 smaller. Particularly, if a cloth, a typical suction member is used as the wiping member W, mechanisms such as a reel mechanism that moves the suction member and a roll of the suction member that is formed by a to-be-used part and a used part of the suction member tend to be increased in size. If the suction unit 12 and the wiping unit 13 are integrated with each other, the mechanisms become complicated. Accordingly, compared to a case of configuring in the separate bodies, there is a possibility of an increased in size, and thus, the suction unit 12 and the wiping unit 13 need to be configured in the separate bodies.

If the suction unit 12 and the wiping unit 13 are configured in the separate bodies, it is possible to shorten a clearance distance of the recording head 9 from the support surface F1 when moving the suction unit 12 to a space between the recording head 9 and the support surface F1 of the endless belt 4. Furthermore, the suction unit 12 and the wiping unit 13 can be independently driven, and thus, it is possible to individually suppress driving loads thereof during an operation.

The wiping member W according to the embodiment is configured of the cloth that is a suction member and configured to be replaceable in a whole unit. Therefore, it is possible to suppress a disadvantage of ink dripping from the recording head during the wiping. Moreover, since it is possible to replace only the wiping member W among the members configuring the wiping unit 13, a running cost can be suppressed. However, without being limited to this configuration, for example, the wiping member may be a wiper blade configured of an elastic member. The wiping member W according to the embodiment is a suction member and is highly effective for suppressing the ink from dripping from the recording head 9 during the wiping. However, the wiping member is not limited to this configuration.

In addition, the wiping unit 13 is configured to be capable of wiping the ink ejection surface F2 for each color of the ink. That is, the wiping unit 13 is miniaturized. Therefore, the recording apparatus 1 is suppressed from increasing in size.

In the suction unit 12 according to the embodiment, caps 12*a* to 12*d* are provided corresponding to the recording heads 9*a* to 9*d* to perform suction collectively by a pump (not illustrated). That is, the suction unit 12 is capable of collectively sucking the ink inside the nozzle of the recording heads 9*a* to 9*d*. Therefore, it is possible to suppress moving frequencies of the suction unit 12 during the suction, thereby suppressing a movement load.

In the recording apparatus 1 according to the embodiment, the gap S2 between the suction unit 12 and the support surface F1 of the recording medium P on the endless belt 4 is wider than the gap S1 between the ink ejection surface F2 and the support surface F1. That is, the gap S2 between the suction unit 12, which is provided on the farther downstream side of the recording medium P in the transportation direction A than the recording head 9, and the support surface F1 is wider than the gap S1 between the ink ejection surface F2 and the support surface F1. Therefore, the suction unit 12 disposed to have the wide gap S2 with respect to the support surface F1 is suppressed from interfering with the recording medium P.

In addition, it is more preferable if the recording apparatus 1 be useable under an environment of relative humidity of 70% RH or more and bring the recording medium P into contact with the endless belt 4 for transportation. If at least one of the gap between the support surface F1 of the endless belt 4 and the suction unit 12 and the gap between the support surface F1 thereof and the wiping unit 13 is excessively narrow, the vapor remains in a minute space and becomes a water drop, thereby degrading an ability of the endless belt 4 to transport the recording medium P. This phenomenon more remarkably occurs in a case of the recording apparatus in which an AC voltage is applied by a charging means and a positive charging region and a negative charging region are alternatively formed along a movement direction of the belt in the endless belt 4.

However, even in this case, according to the invention that widens the gap S2, it is possible to suppress the degrading of the transportation ability.

In addition, regardless of the position to be on the upstream side and the downstream side of the recording medium P in the transportation direction A, it is preferable that the gap between at least one of the suction unit 12 and the wiping unit 13 with respect to the support surface F1 be wider than the gap S1 because the interference between at least one of the suction unit 12 and the wiping unit 13, which is disposed to have a wide gap between the one and the support surface F1, and the printing medium P can be suppressed. Particularly, for example, in a recording apparatus in which the wiping unit 13, in place of the suction unit 12, is provided on the farther downstream side in the transportation direction A than the recording head 9, it is preferable that the gap between the wiping unit 13 and the support surface F1 be configured to be wider than the gap between the ink ejection surface F2 and the support surface F1.

In the recording apparatus 1 according to the embodiment, the wiping unit 13 is provided at a position separated farther away from the support surface F1 than the suction unit 12 in the movement direction (direction Z) of the recording head 9. That is, the suction unit 12 is disposed on a lower side than the wiping unit 13 in a vertical direction.

In a state of at least wiping is not being carried out, when wiping is performed according to such a configuration, a second movement mechanism 19 only moves the suction unit 12 and a third movement mechanism 20 only moves the wiping unit 13 in a horizontal direction individually, the second movement mechanism 19 and the third movement mechanism 20 can be simply configured.

In addition, when the wiping member W is replaceable, particularly, the wiping member W is easily replaced in a recording apparatus in which an upper surface of the recording apparatus or a side surface of the recording apparatus which is positioned above than the wiping member W is opened and closed to replace the wiping member W. For example, when flashing is performed on a suction caps (caps 12*a* to 12*d*) provided in the suction unit 12, the recording head 9 and the suction caps are easily operated.

In the recording head 9 according to the embodiment, a rack 10 is provided so that the recording head 9 is capable of moving in the direction Z that is a direction (direction in which the recording head 9 approaches and is separated away from the support surface F1) intersecting the support surface F1 by rotating a pinion 11. The rack 10 and the pinion 11 configure a first movement mechanism 18 (refer to FIG. 4). In addition, the suction unit 12 according to the embodiment is capable of moving in a direction Y that is a direction intersecting the movement direction (direction Z) of the recording head 9 by the second movement mechanism 19 (refer to FIG. 4). Furthermore, the wiping unit 13 according to the embodiment is capable of moving in the direction Y that is the direction intersecting the movement direction (direction Z) of the recording head 9 by the third movement mechanism 20 (refer to FIG. 4). The third movement mechanism 20 can move the wiping unit 13 in a direction X along a longitudinal direction of the line head, and the recording apparatus 1 is configured to be capable of wiping for each color of the ink.

The movement direction of the suction unit 12 by the second movement mechanism 19 and the movement direction of the wiping unit 13 by the third movement mechanism 20 are not particularly limited. In addition, the first movement mechanism 18, the second movement mechanism 19 and the third movement mechanism 20 may be any type of mechanism.

Here, the term "moving" in "capable of moving in the direction Z that is a direction (direction in which the recording head 9 approaches and is separated away from the support surface F1)" is used, in the present specification, without being limited to the configuration in which the recording head 9 moves with respect to the support surface F1, to mean that a configuration in which the support surface F1 moves with respect to the recording head 9 is included and a configuration in which either the recording head 9 or the support surface F1 moves with respect to the other is further included. That is, the term is used to mean that the recording head 9 and the support surface F1 are relatively movable in a direction to approach and be separated away from each other.

In addition, the term "direction" in "direction in which the recording head 9 approaches and is separated away from the support surface F1" is also used, without being limited to the direction orthogonal to the support surface F1, to mean that the movement in an oblique direction is included. In a case of the oblique direction, it is preferable to be within 45 degrees based on the orthogonal direction.

Next, a positional relationship of the recording head 9 and the suction unit 12 when sucking the recording head 9 by the suction unit 12 will be described.

Figure 2:
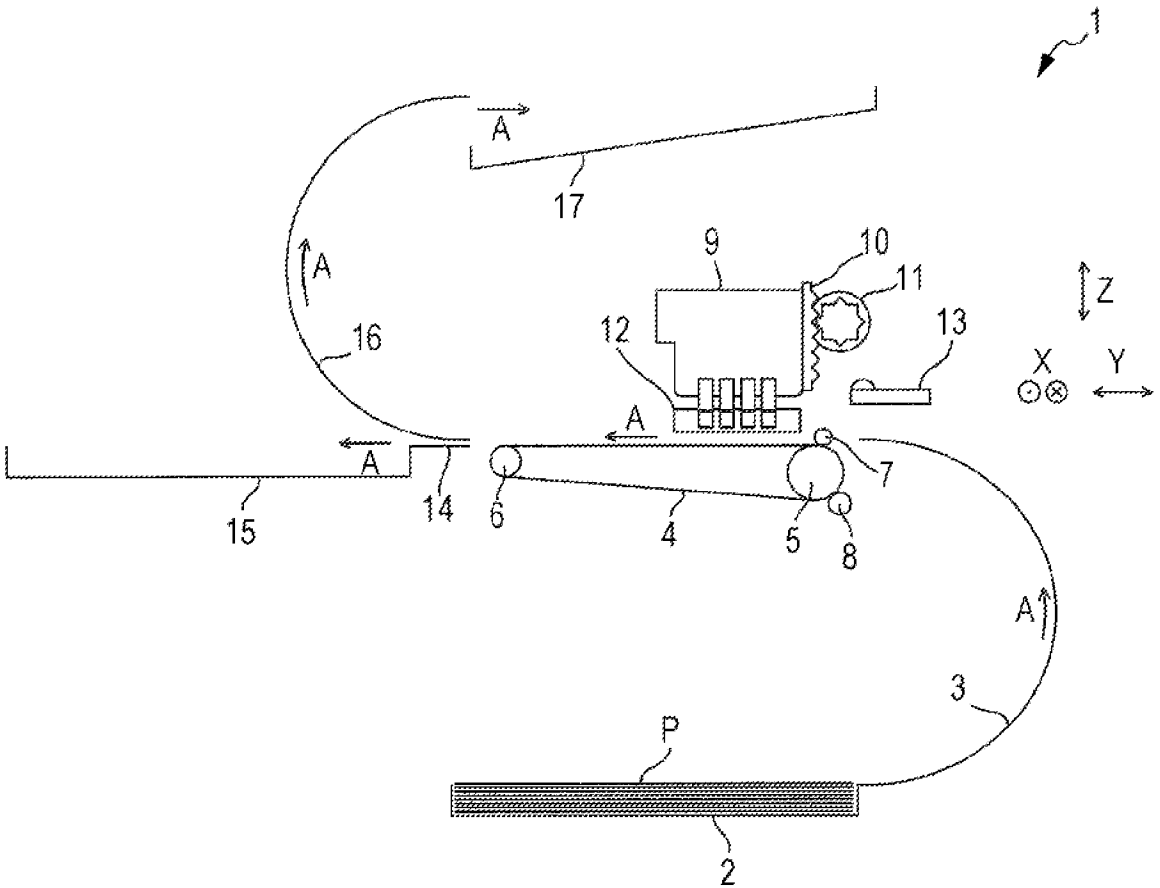
FIG. 2 is a schematic side view showing a state where the recording head is sucked by the suction unit in the recording apparatus according to the embodiment of the invention.

FIG. 2 is a schematic side view showing a state where the recording head 9 is sucked by the suction unit 12 in the recording apparatus 1 according to the embodiment.

When sucking the recording head 9 by the suction unit 12, the recording head 9 moves in a direction in which the gap between the one and the support surface F1 of the recording medium P on the endless belt 4 is widened by the rack 10 and the pinion 11. In accordance with the movement of the recording head 9, the suction unit 12 moves to the suction position between the recording head 9 and the support surface F1 in the direction Y by the second movement mechanism 19. The recording head 9 is lowered to cause the recording heads 9*a* to 9*d* to correspond to the caps 12*a* to 12*d*, and thus, the recording head 9 and the suction unit 12 are in contact with each other.

Here, the term "suction position" denotes a position where the suction unit 12 is operated to suck the ink inside the nozzle with respect to the recording head 9.

In addition, the suction unit 12 is used to mean that when there are a plurality of recording heads 9, the suction unit may be configured either in an assembly body configuration with a plurality of suction caps (for example, caps 12*a* to 12*d*) provided to correspond to each of the recording heads 9 (for example, recording heads 9*a* to 9*d*) or in a single body configuration with a single suction cap 12 that collectively performs sucking with respect to the plurality of recording heads 9. Furthermore, the term is used, in a case of the assembly body configuration of the suction caps 12*a* to 12*d*, to mean that either a configuration in which drive sources individually drive sucking for each of the suction caps 12*a* to 12*d* or a configuration in which a single drive source collectively drives sucking for each of the suction caps 12*a* to 12*d* is included.

In addition, the term "between" in "move the suction unit 12 to the suction position between the recording head 9 and the support surface F1" denotes a space between the ink ejection surface F2 and the support surface F1. That is, the term "between" is not determined based on all the configuration members of the recording head 9.

Figure 4:
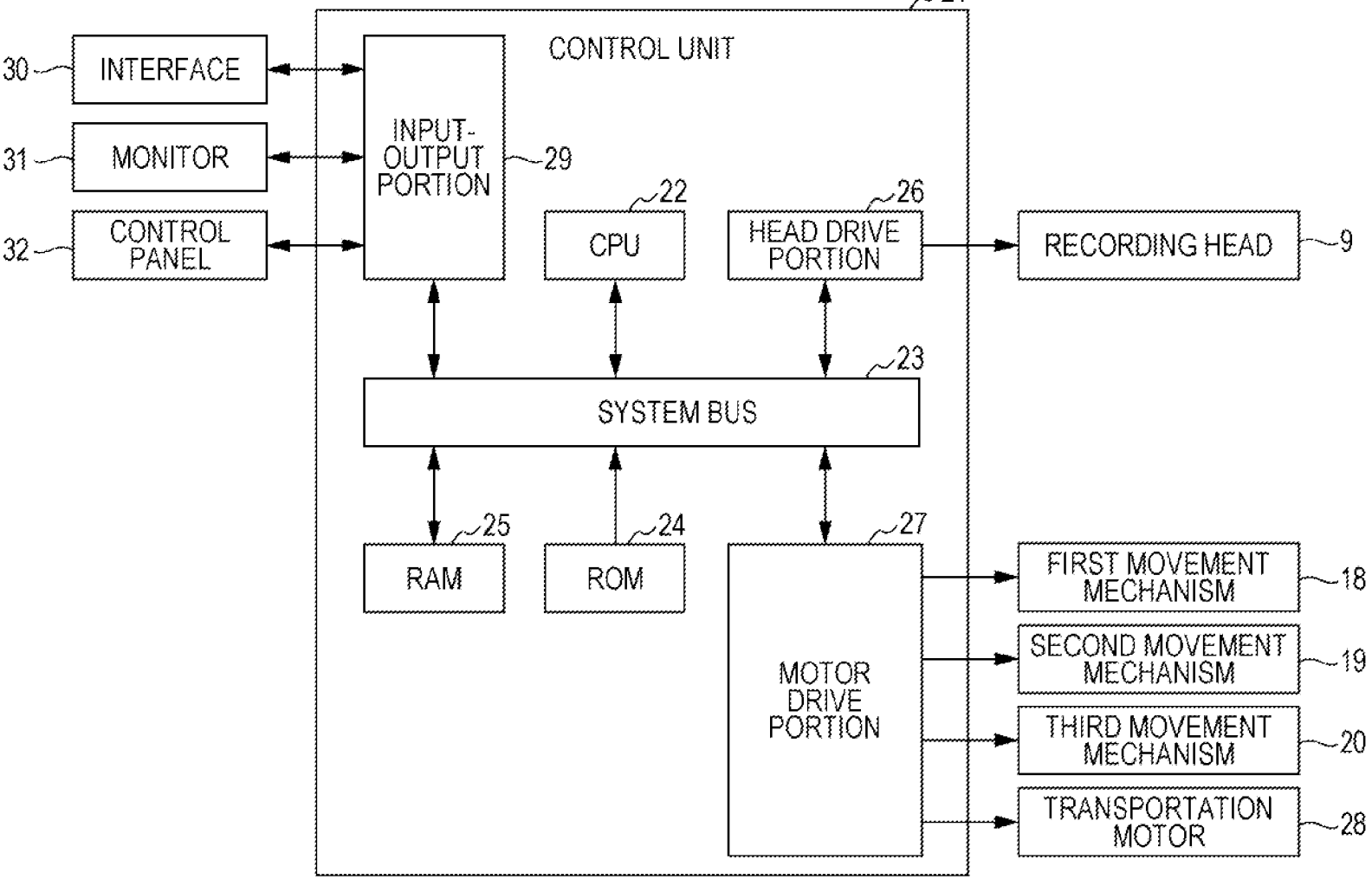
FIG. 4 is a block diagram showing the embodiment of the recording apparatus according to an aspect of the invention.

Such a control when sucking the recording head 9 by the suction unit 12 is performed by controlling of a control unit 21 (refer to FIG. 4). In other words, when sucking the ink inside the nozzle, the control unit 21 controls the first movement mechanism 18 so as to cause the recording head 9 to move in a direction of being separated away from the support surface F1 and controls the second movement mechanism 19 so as to cause the suction unit 12 to move to a position (suction position facing ink ejection surface F2) between the recording head 9 and the support surface F1.

Next, a positional relationship of the recording head 9, the suction unit 12 and the wiping unit 13 when wiping the recording head 9 by the wiping unit 13 will be described.

Figure 3:
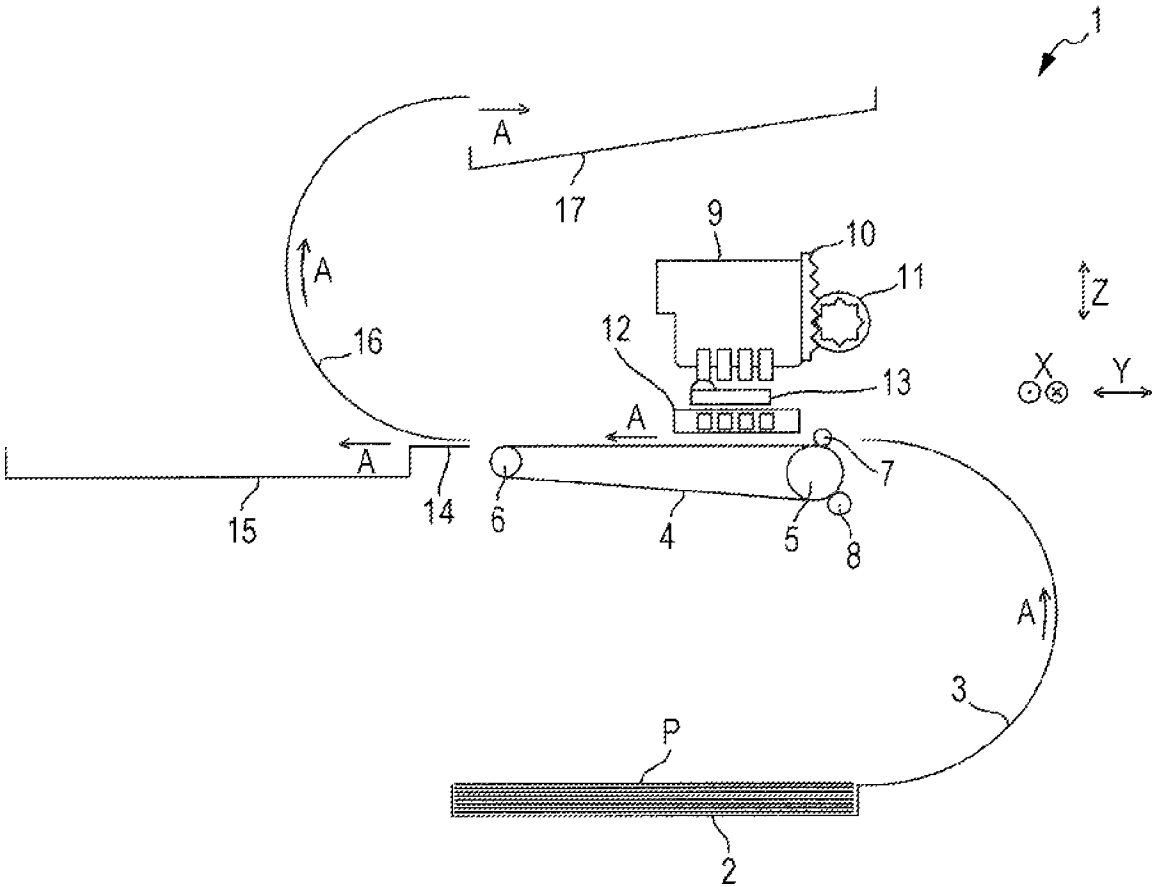
FIG. 3 is a schematic side view showing a state of wiping the recording head by the wiping unit in the recording apparatus according to the embodiment of the invention.

FIG. 3 is a schematic side view showing a state of wiping the recording head 9 by the wiping unit 13 in the recording apparatus 1 according to the embodiment.

When wiping the recording head 9 by the wiping unit 13, the recording head 9 moves in the direction in which the gap between the one and the support surface F1 of the recording medium P on the endless belt 4 is widened by the rack 10 and the pinion 11. In accordance with the movement of the recording head 9, the suction unit 12 moves to the position between the recording head 9 and the support surface F1 in the direction Y by the second movement mechanism 19. In other words, the suction unit 12 moves below (position capable of receiving at least a portion of the ink dripped from the recording head 9) the recording head 9. Then, the wiping unit 13 moves to the wiping position (position facing the ink ejection surface F2) between the recording head 9 and the suction unit 12 in the direction Y by the third movement mechanism 20.

Here, the term "below the recording head 9" is used to mean that not only a lower side of the recording head 9 in the vertical direction but also a peripheral position thereof are included, and that is a position capable of receiving at least a portion of the ink dripped from the recording head 9. The ink dripped from the recording head 9 includes, for example, an ink dripped from the recording head 9 via other members such as the wiping unit 13 in addition to the ink dripped directly from the recording head 9.

In addition, the term "between" in "move to a wiping position between the recording head 9 and the suction unit 12" denotes a space between the ink ejection surface F2 and a part facing the ink ejection surface F2 of the suction unit 12 in a positioned state below the recording head 9. That is, the term "between" is not determined based on all the configuration members of the recording head 9 and all the configuration members of the suction unit 12.

In addition, the term "wiping position" denotes a position where the wiping unit 13 performs a wiping operation on the ink ejection surface F2.

Such a control when wiping the recording head 9 by the wiping unit 13 is performed by controlling of a control unit 21. In other words, when wiping the ink ejection surface F2, the control unit 21 controls the second movement mechanism 19 so as to cause the suction unit 12 to move to the position (below recording head 9) where the ink dripped from the recording head 9 can be received and controls the third movement mechanism 20 so as to cause the wiping unit 13 to move to the space (position facing ink ejection surface F2) between the recording head 9 and the suction unit 12.

Here, the term "move the wiping unit 13 to the position facing the ink ejection surface F2" is used to mean that a movement of a portion of the wiping unit 13 to the position facing the ink ejection surface F2 in addition to a movement of the wiping unit 13 in its entirety to the position facing the ink ejection surface F2 is included.

In the recording apparatus 1 according to the embodiment, the ink is suppressed from dripping onto the support surface F1 of the recording medium P according to such a configuration. In addition, when the wiping is successively performed by the wiping unit 13 with respect to the recording head 9 after sucking the recording head 9 by the suction unit 12, the apparatus is changed from a state of FIG. 2 to a state of FIG. 3.

That is, when sucking the ink inside the nozzle and wiping the ink ejection surface F2, the control unit 21 controls the first movement mechanism 18 to separate the recording head 9 away from the support surface F1 and controls the second movement mechanism 20 to move the suction unit 12 to the suction position between the recording head 9 and the support surface F1. Then, after a suction operation is executed by the suction unit 12, the control unit 21 controls the first movement mechanism 18 to separate the recording head 9 away from the suction unit 12 and controls the third movement mechanism 20 to move the wiping unit 13 to the wiping position between the recording head 9 and the suction unit 12.

In the recording apparatus 1 according to the embodiment, the suction unit 12 can be moved to the space between the recording head 9 and the support surface F1 and the position where the ink dripping from the recording head 9 can be received according to such a configuration.

Next, an electrical configuration in the recording apparatus 1 according to the embodiment will be described.

FIG. 4 is a block diagram of the recording apparatus 1 according to the embodiment.

A CPU 22 that manages controlling the recording apparatus 1 in its entirety is provided in the control unit 21. The CPU 22 is connected to a ROM 24 that stores various types of control programs executed by the CPU 22 and to a RAM 25 that is capable of temporarily storing data via a system bus 23. In addition, the CPU 22 is connected to a head drive portion 26 for driving the recording head 9 via the system bus 23.

In addition, the CPU 22 is connected to a motor drive portion 27 for driving the first movement mechanism 18, the second movement mechanism 19, the third movement mechanism 20 and a transportation motor 28 via the system bus 23. Here, the transportation motor 28 is a motor for driving the rollers 5 and 6 and the transportation roller (not illustrated) that is provided in the transportation routes 3 and 16 and the like.

Furthermore, the CPU 22 is connected to a monitor 31, a control panel 32, an interface 30 for inputting recording data and the like from an external apparatus such as a PC and the like, and an input and output portion 29 for transceiving the data and signals which are provided in the recording apparatus 1.

According to such a configuration, the control unit 21 controls a movement operation of the first movement mechanism 18, the second movement mechanism 19 and the third movement mechanism 20.

The entire disclosure of Japanese Patent Application No. 2013-062841, filed Mar. 25, 2013 is expressly incorporated by reference herein.

What is claimed is:

1. A recording apparatus comprising:

a transportation mechanism that supports and transports a recording medium by a support surface;

a recording head that is disposed in a region facing the support surface and is capable of ejecting ink from a nozzle provided on an ink ejection surface of the recording head to the recording medium;

a suction unit that is capable of sucking the ink from inside the nozzle; and a wiping unit that is provided as a separate body from the suction unit and is capable of wiping the ink ejection surface, wherein at least one of the suction unit and the wiping unit is provided farther downstream in a transportation direction of the recording medium than the recording head and a gap between the at least one of the suction unit and the wiping unit and the support surface is wider than a gap between the ink ejection surface and the support surface, wherein the at least one of the suction unit and the wiping unit not provided downstream is provided farther upstream in the transportation direction of the recording medium than the recording head.

2. The recording apparatus according to claim 1, wherein the transportation mechanism has an endless belt that is capable of supporting the recording medium.

3. The recording apparatus according to claim 2, wherein the recording head is disposed on the upstream side of the recording medium in the transportation direction within a region facing a region where the endless belt transports the recording medium.

4. The recording apparatus according to claim 1, further comprising:

a first movement mechanism that is capable of moving in a direction in which the recording head approaches and is separated away from the support surface;

a second movement mechanism that is capable of moving the suction unit;

a third movement mechanism that is capable of moving the wiping unit; and a control unit that controls the first movement mechanism so as to move the recording head in the direction to be separated away from the support surface and controls the second movement mechanism so as to move the suction unit to a suction position facing the ink ejection surface when sucking the ink inside the nozzle, and controls the second movement mechanism so as to cause the suction unit to be positioned below the recording head and controls the third movement mechanism so as to move the wiping unit to the position facing the ink ejection surface when wiping the ink ejection surface.

5. The recording apparatus according to claim 1, wherein the wiping unit has a wiping member, and the wiping member is replaceable.

6. The recording apparatus according to claim 1, further comprising:

a discharge mechanism that inverts and discharges the recording medium recorded by ejection of the ink from the nozzle.

7. The recording apparatus according to claim 1, wherein the recording head is a line head.

8. The recording apparatus according to claim 1, wherein the ink contains water within a range of 20 mass % to 70 mass %.

* * * * *